US007055331B2

(12) United States Patent
Graf et al.

(10) Patent No.: US 7,055,331 B2
(45) Date of Patent: Jun. 6, 2006

(54) BURNER ARRANGEMENT FOR THE ANNULAR COMBUSTION CHAMBER OF A GAS TURBINE

(75) Inventors: Peter Graf, Küssaberg (DE); Stefan Tschirren, Nunningen (CH); Helmar Wunderle, Waldshut-Tiengen (DE)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/890,565

(22) Filed: Jul. 14, 2004

(65) Prior Publication Data

US 2005/0039464 A1 Feb. 24, 2005

Related U.S. Application Data

(63) Continuation of application No. PCT/CH02/00697, filed on Dec. 16, 2002.

(30) Foreign Application Priority Data

Jan. 14, 2002 (CH) ..... 0050/02

(51) Int. Cl.
*F02C 3/00* (2006.01)
*F02C 7/20* (2006.01)
*F23R 3/50* (2006.01)

(52) U.S. Cl. ..... 60/798; 60/746; 60/747; 60/748

(58) Field of Classification Search ..... 60/798, 60/800, 737, 746, 747, 748
See application file for complete search history.

(56) References Cited

U.S. PATENT DOCUMENTS

| | | | | |
|---|---|---|---|---|
| 3,724,207 | A | 4/1973 | Johnson | |
| 4,765,146 | A * | 8/1988 | Hellat et al. | 60/746 |
| 4,805,411 | A * | 2/1989 | Hellat et al. | 60/746 |
| 5,372,008 | A * | 12/1994 | Sood | 60/746 |
| 5,373,695 | A | 12/1994 | Aigner et al. | |
| 5,829,967 | A | 11/1998 | Chyou | |
| 5,983,643 | A | 11/1999 | Kiesow | |
| 6,058,710 | A * | 5/2000 | Brehm | 60/747 |
| 6,070,412 | A * | 6/2000 | Ansart et al. | 60/747 |
| 6,189,211 | B1 * | 2/2001 | Suter | 29/889.1 |
| 6,212,870 | B1 * | 4/2001 | Thompson et al. | 60/746 |

FOREIGN PATENT DOCUMENTS

EP 0 597 138 A1 5/1994

OTHER PUBLICATIONS

Franz Joos et al., "Development of the sequential combustion system for the GT24/GT26 gas turbine family," ABB Review (Apr. 1998) pp. 4-16.

* cited by examiner

*Primary Examiner*—Ted Kim
(74) *Attorney, Agent, or Firm*—Steptoe & Johnson LLP

(57) ABSTRACT

In a burner arrangement for the annular combustion chamber of a gas turbine, a plurality of burners are arranged above one another, in each case in pairs in the radial direction, on concentric rings. In a burner arrangement of this type, the mechanical integrity of the turbine casing is increased and operation of the combustion chamber is optimized by virtue of the two burners in a pair of burners being oriented out of the parallel position, in such a manner that their burner axes converge in the direction of flow.

11 Claims, 1 Drawing Sheet

BURNER ARRANGEMENT FOR THE ANNULAR COMBUSTION CHAMBER OF A GAS TURBINE

CROSS-REFERENCE TO RELATED APPLICATIONS

This application is a continuation of the U.S. National Stage designation of co-pending International Patent Application PCT/CH02/00697 filed Dec. 16, 2002, the entire content of which is expressly incorporated herein by reference thereto.

FIELD OF THE INVENTION

The present invention deals with the field of gas turbine technology. It relates to a burner arrangement for the annular combustion chamber of a gas turbine.

BACKGROUND OF THE INVENTION

A burner arrangement is known, for example, from EP-A1 0 597 138.

Nowadays, annular low-NOx (EV) combustion chambers (EV=Environmental) for gas turbines with a single row of burners are considered proven technology (cf. for example F. Joos et al. "Development of the sequential combustion system for the GT24/GT26 gas turbine family", ABB review 4, 1998 pp. 4–16 (1998)). The burners in these gas turbines/combustion chambers can be removed through corresponding access openings in the outer turbine casing.

Other gas turbines (e.g. of type GT13E in the name of the Applicant) have a two-row arrangement of burners in the annular combustion chamber, as shown for example in FIGS. 1 and 3 of document EP-A1 0 597 138. In the form shown there (with pairs of burners oriented parallel), a two-row arrangement of this type can only be realized on account of the fact that the burners cannot be removed outward, but rather have to be removed by being pulled inward into the combustion chamber. The combustion chamber has to be large enough for this to occur and must also be externally accessible through a special manhole (cf. FIG. 2 of EP-A1 0 597 138 and the associated description). The openings for the fuel feedlines in the turbine casing may in this case be small.

One drawback of the known two-row burner arrangement is the complex access to the combustion chamber via corresponding manholes which is required to change the burners. A further drawback is the operation of changing the burners, which is time-consuming in this solution. The provision of access openings in the turbine casing, through which the burners can easily be pulled out in the outward direction, however, causes problems with regard to the mechanical integrity of the turbine casing. The turbine casing has to satisfy certain mechanical demands and should not be deformed or crack under pressure and thermal loading. Therefore, it is necessary to maintain a minimum distance between access openings of this type in the outer turbine casing. This is highly important in particular in the case of double-row burner arrangements.

Furthermore, in any combustion chamber it is desirable for the hot gases to be thoroughly mixed in the primary zone. Therefore, particularly in the case of burner arrangements with two or more rows, it is necessary to find ways of achieving a mixing which is sufficient even under part-load operation, in which the operation of the burners is stepped down.

Finally, it is observed that the burners produce hotspots on the inner linings of the combustion chamber, where the hot gas flowing out of the burners impinges on the walls.

U.S. Pat. No. 5,829,967 has disclosed a combustion chamber with two-stage combustion. It has a primary burner of the premixing type, in which the fuel injected via nozzles, inside a premixing space, is intensively mixed with the combustion air prior to ignition. The primary burners are designed to have a flame-stabilizing action, i.e. without mechanical flame holders. They are provided with tangential flow of the combustion air into the premixing space. Downstream of a preliminary combustion chamber there are secondary burners, which are designated as premix burners that are not independent. U.S. Pat. No. 3,724,207 also discloses a combustion chamber.

SUMMARY OF THE INVENTION

Therefore, the invention relates to a double-row burner arrangement for annular combustion chambers that allows the burners to be removed directly outward through the turbine casing without adversely affecting the mechanical integrity of the turbine casing, improves the mixing of the hot gases in the combustion chamber and reduces the thermal loading on the walls of the combustion chamber.

Advantageously, the burners in the two rows of burners are no longer oriented with their burner axes parallel to one another, but rather with their burner axes converging in the direction of flow. This results in an increasing (lateral) distance between the burner axes in the opposite direction to the direction of flow, toward the outer turbine casing; this increasing distance leads to a greater distance between corresponding access openings for the burners in the outer turbine casing and therefore also to much less mechanical weakening of the casing. Since the burner axes converge in the combustion chamber, the gases expelled into the combustion chamber from the burners also mingle with one another to a greater extent, which leads to improved mixing. At the same time, the inclination of the burners toward one another results in reduced impingement of the hot burner gases on the outer combustion chamber walls, with the result that the thermal loading thereon is reduced.

In this context, a "symmetrical" burner arrangement, in which the two burners belonging to a pair of burners are arranged on both sides of the center axis of the combustion chamber cross-section and in which the burner axes of the two burners each include an angle ($\alpha$) of greater than 0° and less than 90° with the center axis, is preferred.

BRIEF DESCRIPTION OF THE DRAWINGS

The invention is to be explained in more detail below on the basis of exemplary embodiments in conjunction with the drawing.

DETAILED DESCRIPTION OF THE PREFERRED EMBODIMENTS

Figure 1:
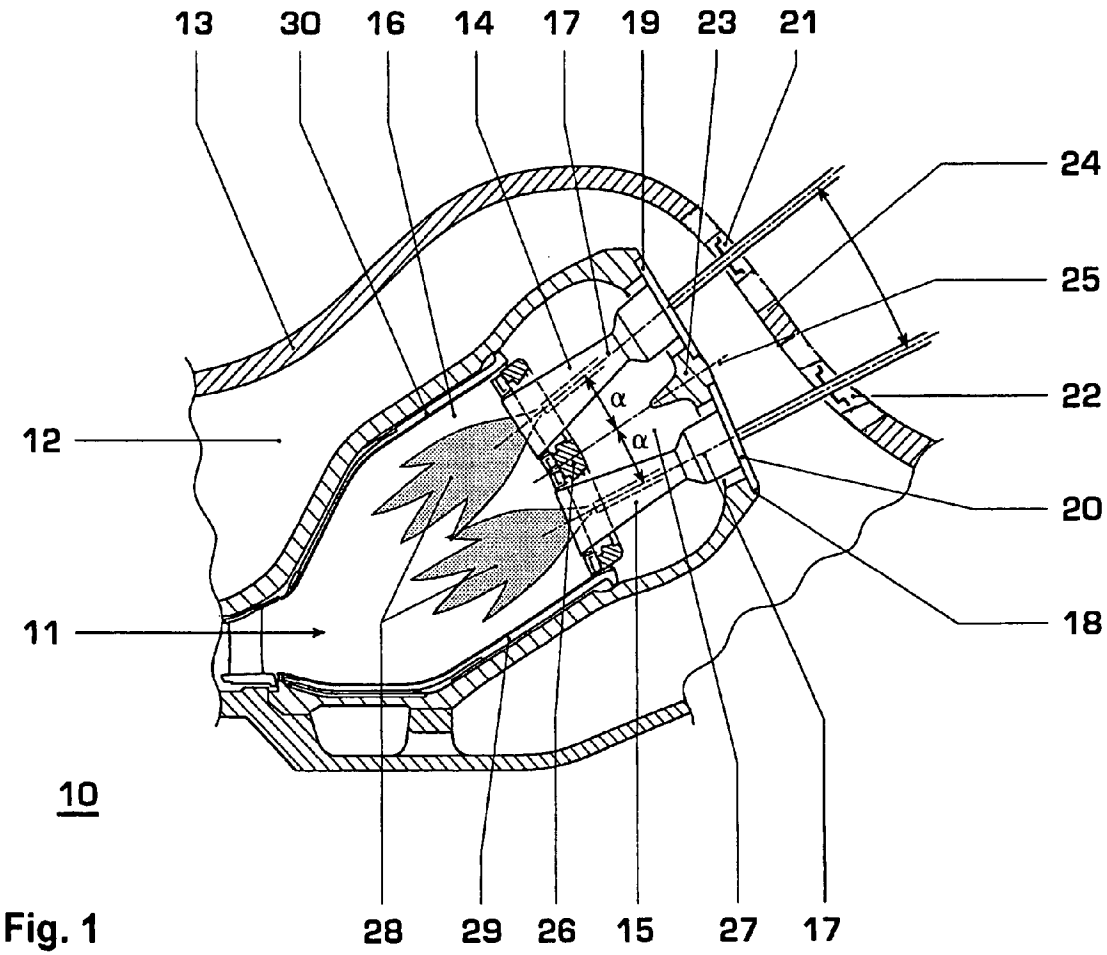
FIG. 1 shows an excerpt from a section through a gas turbine having an annular combustion chamber and a two-row burner arrangement in accordance with a preferred exemplary embodiment of the invention.

FIG. 1 shows a section through the combustion chamber of a gas turbine 10 with a burner arrangement in accordance with a preferred exemplary embodiment of the invention. The gas turbine 10, of which only an excerpt located above the turbine axis is shown, has an outer turbine casing 13, which surrounds a plenum 12 filled with compressed air and a combustion chamber 11 arranged between compressor part and turbine part. The combustion chamber 11 is of annular design with respect to the turbine axis. Burners 14, 15 are arranged one above the other in two rows in its entry-side head space 27 and are designed in a known way as double-cone burners, open out into the combustion chamber 11 and fire a primary combustion zone 16. Between the burners there is an intermediate region 26. The burners 14, 15 form coaxial rings, as is similarly illustrated (albeit with an alternating offset) in FIG. 3 in EP-A1 0 597 138. The head space 27 is closed off with respect to the outside (to the plenum 12) by a combustion-chamber casing 18. Suitable openings for the burners 14, 15, through which the burners 14, 15 can be withdrawn outward, are provided in the combustion-chamber casing 18. Flanges 19, 20 are arranged on the burners 14, 15 themselves and are used to screw the burners 14, 15 securely to the combustion-chamber casing 18; these flanges simultaneously close off the openings. Openings 21, 22, through which the burners 14, 15 can be withdrawn directly and completely outward are also provided in the outer turbine casing 13, which is located further to the outside.

The significant factor in this context is that the burners 14, 15, arranged above one another in pairs, are no longer oriented with their burner axes 17 parallel to one another, but rather are inclined with respect to one another in such a manner that the burner axes 17 converge in the direction of flow (to the left in the figure). This inclination is preferably designed to be symmetrical with respect to the center axis 25 of the combustion-chamber cross-section: each burner 14, 15 has its burner axis 17 inclined by the same angle $\alpha$ out of the center axis 25. In the exemplary embodiment illustrated in the figure, the angle $\alpha$ is approximately 5°. It is in general terms greater than 0° and less than 90°.

The inclination of the burners 14, 15 with respect to one another widens the intermediate regions 23, 24 between the openings in the combustion-chamber casing 18 and the openings 21, 22 in the outer turbine casing 13, thereby providing space for securing means and significantly increasing the mechanical stability of the casings. The inclination also increases the interaction between the flames 28 of the adjacent burners 14, 15, which leads to improved mixing of the hot gases. Finally, on account of the inclination of the burners 14, 15, the flames 28 in the primary combustion zone 16 do not impinge as strongly on the inner and outer lining segments 29 and 30 of the combustion chamber 11, with the result that the thermal loading on these segments is significantly reduced.

Overall, the invention provides the following effects and advantages:

There is sufficient space between the rows of burners for the associated flanges to be screwed to the housings or supports.

The inclined arrangement of the burners 14, 15 results in a greater distance between the access openings in the outer turbine casing. This reduces the concentration of mechanical stresses in the region of the opening distribution.

In premix operation, the mixing between the lower (inner) burner row and the upper (outer) burner row is made more intensive.

The distance between the flames and the inner and outer lining segments is increased, thereby reducing the local thermal loading on the segments.

LIST OF DESIGNATIONS

| | |
|---|---|
| 10 | Gas turbine |
| 11 | Combustion chamber |
| 12 | Plenum |
| 13 | (outer) turbine casing |
| 14, 15 | Burners (double-cone burners) |
| 16 | Primary combustion zone of the combustion chamber 11 |
| 17 | Burner axis |
| 18 | Combustion-chamber casing |
| 19, 20 | Flange |
| 21, 22 | Opening |
| 23, 24, 26 | Intermediate region |
| 25 | Center axis (combustion chamber cross-section) |
| 27 | Head space |
| 28 | Flame |
| 29 | Lining segment (inner) |
| 30 | Lining segment (outer) |
| $\alpha$ | Angle |

What is claimed is:

1. A burner arrangement for an annular combustion chamber of a gas turbine comprising:

a plurality of double-cone burners each having a burner axis and a cone opening into the combustion chamber and being arranged in pairs in the combustion chamber, the pairs comprising burners spaced in a radial direction and disposed in concentric rings;

wherein the burner axes in each pair converge in a direction of flow for firing a primary combustion zone of the combustion chamber;

wherein the burners are arranged in a head space of the combustion chamber that is surrounded by a combustion-chamber casing; and wherein openings are provided in the combustion-chamber casing for permitting outward removal of the burners.

2. The burner arrangement of claim 1, wherein the burners of a pair are arranged about a center axis of a cross-section of the combustion chamber, and the burner axes of the burners of the pair each are oriented at an angle of greater than 0° and less than 90° with the center axis.

3. The burner arrangement of claim 1, wherein the burner axes of a pair of burners each are disposed at an angle no more than 90° with respect to a center axis of the combustion chamber.

4. The burner arrangement of claim 1, wherein flanges are arranged on the burners for closing the openings.

5. The burner arrangement of claim 1, wherein the combustion chamber is arranged inside an outer turbine casing having openings for permitting the burners to be removed.

6. A burner arrangement for an annular combustion chamber of a gas turbine comprising:

radially spaced pairs of double-cone burners each having a cone opening into the combustion chamber, the burners in each pair disposed in concentric rings and disposed along burner axes that converge in a direction of flow for firing a primary combustion zone of the combustion chamber;

wherein the burners are arranged in a head space of the combustion chamber that is surrounded by a combustion-chamber casing; and wherein openings are provided in the combustion-chamber casing for permitting outward removal of the burners.

7. The burner of claim 6, wherein the burner axes of a pair of burners each are inclined at an angle between 0° and 90° with respect to a central axis of the combustion chamber.

8. The burner of claim 6, wherein the burner axes of a pair of burners each are inclined at an angle between 0° and 90° with respect to a central axis of the combustion chamber and are symmetrically disposed about the central axis.

9. A burner arrangement for an annular combustion chamber of a gas turbine comprising:

radially spaced pairs of double-cone burners each having a cone opening into the combustion chamber, the burners in each pair disposed in inner and outer rows and disposed along burner axes that converge in a direction of flow for firing a primary combustion zone of the combustion chamber;

wherein the burners are arranged in a head space of the combustion chamber that is surrounded by a combustion-chamber casing; and wherein openings are provided in the combustion-chamber casing for permitting outward removal of the burners.

10. The burner of claim 9, wherein the burner axes of a pair of burners each are inclined at an angle between 0° and 90° with respect to a central axis of the combustion chamber.

11. The burner of claim 9, wherein the burner axes of a pair of burners each are inclined at an angle between 0° and 90° with respect to a central axis of the combustion chamber and are symmetrically disposed about the central axis.

* * * * *